US005501932A

United States Patent [19]

Sugawara et al.

[11] Patent Number: 5,501,932

[45] Date of Patent: Mar. 26, 1996

[54] CHARGE CONTROL AGENT AND TONER FOR DEVELOPING ELECTROSTATIC IMAGES

[75] Inventors: Shuji Sugawara, Neyagawa; Kazuaki Sukata, Yawata; Shun-ichiro Yamanaka, Hirakata, all of Japan

[73] Assignee: Orient Chemical Industries, Ltd., Osaka, Japan

[21] Appl. No.: 219,613

[22] Filed: Mar. 29, 1994

[30] Foreign Application Priority Data

Mar. 31, 1993 [JP] Japan ..... 5-098523

[51] Int. Cl.[6] ..... G03G 9/097

[52] U.S. Cl. ..... 430/110; 430/107; 430/109; 430/903

[58] Field of Search ..... 430/110, 109, 430/107, 903

[56] References Cited

U.S. PATENT DOCUMENTS

| | | | |
|---|---|---|---|
| 3,944,493 | 3/1976 | Jadwin et al. | 430/110 |
| 4,592,989 | 6/1986 | Smith et al. | 430/110 |

FOREIGN PATENT DOCUMENTS

| | | |
|---|---|---|
| 53-13284 | 5/1978 | Japan . |
| 59-90864 | 5/1984 | Japan . |
| 63-141072 | 6/1988 | Japan . |
| 1-262555 | 10/1989 | Japan . |
| 1-54696 | 11/1989 | Japan . |
| 4-29062 | 5/1992 | Japan . |

OTHER PUBLICATIONS

Yanagida et al. Nov. 1978. Metal–ion complexation of noncyclic poly(oxyethylene) derivatives. III. Complexation in aprotic solvent and isolation of their solid complexes. *Bull. Chem. Soc. Jpn.* 51:3111–3120.

Tümmler et al. May 1979. Open chain polyethers. Influence of aromatic donor end groups on thermodynamics and kinetics of alkali metal ion complex formation. *Journal of the American Chemical Society* 101:2588–2598.

Yamaguchi et al. Apr. 1989. Studies on synthetic ionophores. VIII. Transport of alkaline earth metal ions by polyether carboxylic acids through liquid membrane. *Bull. Chem. Soc. Jpn.* 62:1097–1101.

Yamaguchi et al. Jun. 1988. Studies on synthetic ionophores. VI. Synthesis of polyether carboxylic acids and their use as carriers for alkali metal ion transport through liquid membrane. *Bull. Chem. Soc. Jpn.* 61:2047–2054.

Kasuga et al. Dec. 1991. Studies on synthetic ionophores. IX. X–ray crystal structure analysis of potassium, rubidium, and cesium salts of a synthetic carboxylic ionophore. *Bull. Chem. Soc. Jpn.* 63:3548–3556.

*Primary Examiner*—Janis L. Dote

*Attorney, Agent, or Firm*—McGlew and Tuttle

[57] ABSTRACT

A positive charge control agent whose active ingredient is a complex salt compound of the amine derivative represented by the following formula [1]:

$$\begin{array}{l} \quad\;\; (CH_2)_p-(X^a-L^1)_q-X^1-A^1 \\ N-(CH_2)_p-(X^a-L^1)_q-X^2-A^2 \quad .K1.A1 \\ \quad\;\; (CH_2)_p-(X^a-L^1)_q-X^3-A^3 \end{array} \qquad [1]$$

wherein $X^a$, $X^1$, $X^2$ and $X^3$ independently represent —O— or —S—;

$L^1$ represents a divalent group selected from the group consisting of alkylene groups having 1 to 4 carbon atoms which are branched or not branched, cycloalkylene groups, and monocyclic or polycyclic arylene groups which have or do not have a substituent;

$A^1$, $A^2$ and $A^3$ independently represent hydrogen, an alkyl group, a cycloalkyl group, an aralkyl group, a monocyclic or polycyclic aryl group which has or does not have a substituent or a residue of a nitrogen-containing heterocyclic compound having an —OH group or an —SH group;

p represents an integer from 1 to 4;

q represents an integer from 0 to 20;

K1·A1 represents an organic or inorganic salt capable of forming a complex with an amine derivative, in which K1 is a cation selected from the group consisting of alkali metal ions, alkaline earth metal ions, ammonium ions and pyridinium ions, and A1 is an anion of an organic or inorganic acid.

12 Claims, No Drawings

CHARGE CONTROL AGENT AND TONER FOR DEVELOPING ELECTROSTATIC IMAGES

BACKGROUND OF THE INVENTION

1. Field of the Invention

The present invention relates to a positively chargeable toner for developing electrostatic latent images used for electrophotography, electrostatic recording, electrostatic printing and other purposes, and a positive charge control agent capable of controlling the amount of charges of the toner.

2. Description of the Prior Art

In copying machines and other equipment based on electrophotography, various dry or wet toners containing a coloring agent, a fixing resin and other substances are used to visualize the electrostatic latent image formed on the photoreceptor having a light-sensitive layer containing an organic or inorganic photoconductive substance.

The chargeability of such toners is the most important factor in electrostatic latent image developing systems. Thus, to appropriately control or stabilize the charge amount of toner, a charge control agent providing a positive or negative charge is often added to the toner.

Examples of charge control agents providing a negative charge for toner in actual application include chromium complex salts, cobalt complex salts, iron complex salts and other salts of azo dyes having a good charge providing property. Examples of charge control agents providing a positive charge for toner in actual application include basic dyes such as nigrosine dyes and triarylmethane dyes. Most of these, however, are relatively densely colored.

For general applicability to color toners Of various colors, the charge control agent must be colorless or colored lightly to the extent that the tone of the color toners is not affected. There are a large number of positive charge control agents meeting these requirements, including quaternary ammonium salt compounds (e.g., Japanese Patent Examined Publication No. 54696/1989), pyridinium salt compounds (e.g., Japanese Patent Examined Publication No. 29062/1992), imidazole compounds (e.g., Japanese Patent Open to Public Inspection (hereinafter referred to as Japanese Patent O.P.I. Publication) No. 262555/1989), triazine compounds (e.g., Japanese Patent O.P.I. Publication No. 141072/1988), amine compounds (e.g., Japanese Patent O.P.I. Publication No. 90864/1984) and polyamine resins (e.g., Japanese Patent Examined Publication No. 13284/1978).

Among the toners incorporating conventional positive charge control agents, however, many are unsatisfactory in charge stability in multiple repeated use; for example, the toner charge distribution is uneven due to the poor compatibility or dispersibility of the charge control agent with the toner resin, and the resulting charge is not stably retained due to a lack of environmental stability. Against this background, there is a need of the development of a positive charge control agent excellent in such properties, and black toners and color toners containing it.

In recent years, some toners positively or negatively charged by introducing a polar group to the resin itself or by another means have been proposed, but they have various problems to be solved as to chargeability and other properties.

The object of the present invention, developed in view of the above problems involved in prior art methods, is to provide a positive charge control agent which is versatile for use in various color toners, including those of the three subtractive primaries, i.e., yellow, magenta and cyan, and achromatic toners, which is excellent in charge control property stability to changes in temperature and humidity, i.e., environmental resistance, stability of charge control property over time, i.e., storage stability, and stability of charge control property in multiple repeated use of the toner, i.e., durability, and a positively chargeable toner for electrostatic images which can be used as a toner of various chromatic or achromatic colors and which is excellent in environmental resistance, storage stability and durability.

SUMMARY OF THE INVENTION

The present inventors investigated positive charge control agents, and found that the above-described object can be accomplished by a (metal) complex salt compound of a particular amine or pyridine derivative, capable of interaction with an alkali metal ion, alkaline earth metal ion or ammonium ion, and a toner incorporating the (metal) complex salt compound. The inventors made further investigations based on this finding, and developed the present invention.

Accordingly, the charge control agent of the present invention contains as an active ingredient a complex salt compound selected from the group consisting of complex salt compounds of the amine derivatives represented by the following formulas [1] and [2], respectively, and complex salt compounds of the pyridine derivative represented by the following formula [3]:

$$\begin{array}{l} \quad\;\; (CH_2)_p-(X^a-L^1)_q-X^1-A^1 \\ N-(CH_2)_p-(X^a-L^1)_q-X^2-A^2 \quad .K1.A1 \\ \quad\;\; (CH_2)_p-(X^a-L^1)_q-X^3-A^3 \end{array} \qquad [1]$$

wherein $X^a$, $X^1$, $X^2$ and $X^3$ independently represent —O— or —S—;

$L^1$ represents a divalent group selected from the group consisting of alkylene groups having 1 to 4 carbon atoms which are branched or not branched, cycloalkylene groups, and monocyclic or polycyclic arylene groups which have or do not have a substituent;

$A^1$, $A^2$ and $A^3$ independently represent hydrogen, an alkyl group, a cycloalkyl group, an aralkyl group, a monocyclic or polycyclic aryl group which has or does not have a substituent or a residue of a nitrogen-containing heterocyclic compound having an —OH group or an —SH group;

p represents an integer from 1 to 4;

q represents an integer from 0 to 20;

K1·A1 represents an organic or inorganic salt capable of forming a complex with an amine derivative, in which K1 is a cation selected from the group consisting of alkali metal ions, alkaline earth metal ions, ammonium ions and pyridinium ions, and A1 is an anion of an organic or inorganic acid;

$$\begin{array}{l} \quad\;\; (CH_2)_m-(X^b-L^2)_n-X^4-A^4 \\ RN \qquad\qquad\qquad\qquad .K2.A2 \\ \quad\;\; (CH_2)_m-(X^b-L^2)_n-X^5-A^5 \end{array} \qquad [2]$$

wherein R represents an alkyl group having 1 to 20 carbon atoms or an aralkyl group having 7 to 12 carbon atoms, each of which has or does not have a substituent;

$X^b$, $X^4$ and $X^5$ independently represent —O— or —S—;

$L^2$ represents a divalent group selected from the group consisting of alkylene groups having 1 to 4 carbon atoms which are branched or not branched, cycloalkylene groups, and monocyclic or polycyclic arylene groups which have or do not have a substituent;

$A^4$ and $A^5$ independently represent hydrogen, an alkyl group, a cycloalkyl group, an aralkyl group, a monocyclic or polycyclic aryl group which has or does not have a substituent or a residue of a nitrogen-containing heterocyclic compound having an —OH group or an —SH group;

m represents an integer from 1 to 4;

n represents an integer from 0 to 20;

K2·A2 represents an organic or inorganic salt capable of forming a complex with an amine derivative, in which K2 is a cation selected from the group consisting of alkali metal ions, alkaline earth metal ions, ammonium ions and pyridinium ions, and A2 is an anion of an organic or inorganic acid;

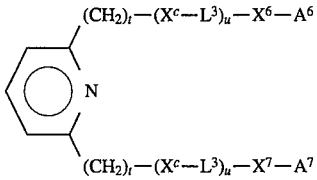

[3]

.K3.A3 wherein $X^c$, $X^6$ and $X^7$ independently represent —O—or —S—;

$L^3$ represents a divalent group selected from the group consisting of alkylene groups having 1 to 4 carbon atoms which are branched or not branched, cycloalkylene groups, and monocyclic or polycyclic arylene groups which have or do not have a substituent;

$A^6$ and $A^7$ independently represent hydrogen, an alkyl group, a cycloalkyl group, an aralkyl group, a monocyclic or polycyclic aryl group which has or does not have a substituent or a residue of a nitrogen-containing heterocyclic compound having an —OH group or an —SH group;

t represents an integer from 1 to 4;

u represents an integer from 0 to 20;

K3·A3 represents an organic or inorganic salt capable of forming a complex with a pyridine derivative, in which K3 is a cation selected from the group consisting of alkali metal ions, alkaline earth metal ions, ammonium ions and pyridinium ions, and A3 is an anion of an organic or inorganic acid.

The complex salt compound as the charge control agent of the present invention causes almost no tone deterioration in the toner image even when it is used in various chromatic or achromatic toners because it is substantially colorless, it is excellent in positive charge providing property, environmental resistance, storage stability and durability, it is good in resin affinity and dispersibility and it is excellently safe because of the absence of heavy metals.

In addition, the positively chargeable toner for developing electrostatic images of the present invention can be used as a toner of various chromatic or achromatic colors, and it is capable of forming a distinct toner image of excellent thin-line reproducibility, excellent in environmental resistance, storage stability and durability, and excellently safe because of the absence of heavy metals.

DETAILED DESCRIPTION OF THE INVENTION

Examples of groups for $L^1$, $L^2$ and $L^3$ in formulas [1], [2] and [3] include alkylene groups from (poly)alkylene glycol such as 1,2-ethylene group, 1,2- or 1,3-propylene group (trimethylene group) and 1,2-, 1,3- or 1,4-butylene group; cycloalkylene groups such as 1,2- or 1,4-cyclohexylene group; and substituted or unsubstituted arylene groups from polyether or (aromatic) diol compounds, such as 1,2-, 1,3- or 1,4-phenylene group, 4-tert-butyl-1,2-phenylene group, 4-chloro-1,2-phenylene group, 4-nitro-1,2-phenylene group, 2,3-naphthylene group and 7-nitro-2,3-naphthylene group.

Examples of groups for $A^1$, $A^2$, $A^3$, $A^4$, $A^5$, $A^6$ and $A^7$ in formulas [1], [2] and [3] include hydrogen, lower alkyl groups such as methyl, ethyl, propyl and butyl, cycloalkyl groups such as cyclohexyl, aralkyl groups such as benzyl and phenethyl, substituted or unsubstituted phenyl groups from phenols, such as (thio)phenol, o-nitrophenol, p-chlorophenol, o-cresol, tert-butylphenol, p-octylphenol and (thio)catechol, substituted or unsubstituted naphthyl groups from 2-naphthol or 2,3-dihydroxynaphthalene, which is or is not substituted by a nitro group, an alkyl group or a halogen, and groups from nitrogen-containing heterocyclic compounds, such as 2-, 3- or 4-hydroxypyridine, 3-, 4-, 5-, 6-, 7- or 8-hydroxyquinoline and 2-hydroxycarbazole, with preference given to the 8-quinolyl group from 8-hydroxyquinoline.

Examples of groups for R in formula [2] include methyl groups, ethyl groups, propyl groups, octyl groups, dodecyl groups, octadecyl groups, benzyl groups and α,α'-dimethylbenzyl groups, whether or not substituted by an alkyl group, a halogen, a cyano group or a hydroxyl group.

Examples of cations K1, K2 and K3 in formulas [1], [2] and [3] include alkali metal ions such as $Li^+$, $Na^+$, $K^+$ and $Rb^+$; alkaline earth metal ions such as $Ca^{2+}$, $Ba^{2+}$, $Mg^{2+}$ and $Sr^{2+}$; ammonium ions (including $NH_4^+$, aliphatic primary, secondary or tertiary amine ammonium, and quaternary ammonium); and pyridinium ions (including pyridinium, N-butylpyridinium, N-benzylpyridinium and N-laurylpyridinium).

Examples of anions A1, A2 and A3 in formulas [1], [2] and [3] include anions of organic or inorganic acids which are counter ions of the above-described cations, such as hydroxyl ions, halogen ions (e.g., $F^-$, $Ci^-$, $Br^-$, $I^-$), thiocyanate ions, (alkyl)sulfate ions, carbonate ions, silicate ions, aromatic acid ions (e.g., salicylate ions) and fatty acid ions (e.g., stearic acid ions).

Preferable salts for K1·A1, K2·A2 and K3·A3 include alkali metal salts (e.g., lithium chloride, sodium chloride, potassium chloride, caesium chloride, potassium iodide, rubidium bromide, sodium fluoride, potassium fluoride, potassium thiocyanate, potassium sulfate, potassium methylsulfate, sodium stearate, potassium salicylate); alkaline earth metal salts (e.g., magnesium chloride, barium chloride, magnesium thiocyanate, barium thiocyanate, barium sulfate, magnesium stearate, magnesium silicate); alkali metal or alkaline earth metal hydroxides (e.g., potassium hydroxide, barium hydroxide, magnesium hydroxide); ammonium salts and pyridinium salts (e.g., ammonium thiocyanate, ammonium stearate, ammonium iodide, methylammonium bromide, tetramethylammonium chloride, trimethylbenzylammonium chloride, N-benzylpyridinium). Of these, alkali metal salts, alkaline earth metal salts and ammonium salts of thiocyanate are particularly preferred for the present invention.

The complex bond in the complex salt compounds of the present invention, represented by formulas [1], [2] and [3], respectively, includes interaction much weaker than the complex bond in conventional complex compounds. From another viewpoint, such complex salt compounds in the present invention can be guest-host compounds wherein the host (component) is an amine derivative and the guest (component) is a metal salt.

The complex salt compound of the present invention is a white (colorless) solid having a positive charge providing property, obtained by heating with a metal salt as described above (e.g., RbI) in an amount of 1 equivalent per 1 to 10, preferably 1 to 5 units of —(X—L)— or —X groups in the amine derivative or pyridine derivative.

The compounds represented by formulas [1], [2] and [3] above are known from the literature, such as Burkhard Tummler et al., J. Am. Chem. Soc., 101:10, May 9, 1979 [Open-Chem Polyethers, Influence of Aromatic Donor End Groups on Thermodynamics and Kinetics of Alkali Metal Ion Complex Formation], and can be synthesized by the methods described therein.

Complex salt compounds as charge control agents in the present invention were synthesized by treating amine derivatives and pyridine derivatives, obtained commercially or synthesized by the methods described in the above-mentioned reference, with organic or inorganic salts or hydroxides of the above-described alkali metals or alkaline earth metals, or ammonium thiocyanate. Examples of the synthesis are given below.

Synthesis Example 1 (Example Compound 1, RbI Complex Salt)

10 g (0.04 mol) of tris(2-chloroethyl)amine hydrochloride, 25 g (0.17 mol) of 8-hydroxyquinoline, 10 g (0.18 mol) of potassium hydroxide and 250 g of n-butanol were refluxed for 6 hours.

After the solvent was distilled off, the residue was extracted with chloroform, washed with water and subjected to chromatography (silica, chloroform-methanol) to separate 17 g of a light yellow liquid (compound [a] of the following structure, yield 74%).

[a]

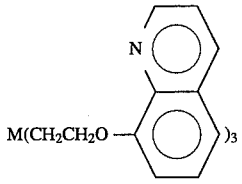

To 2 g (3.6 mmol) of compound [a] above, 0.7 g (3.6 mmol) of rubidium iodide was added, and the mixture was heated to yield 1.1 g (yield 40%) of the desired product as a white power (melting point 110°–112° C.).

Synthesis Example 2 (Example Compound 3, NaI Complex Salt)

2-(2-chloroethoxy)ethanol and 8-hydroxyquinoline were reacted to yield the following compound [b].

[b]

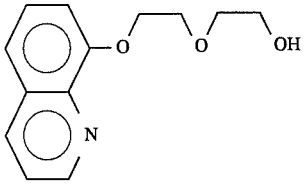

Next, 21.0 g (90 mmol) of compound [b], 6.1 g (30 mmol) of tris(2-chloroethyl)amine hydrochloride, 14.0 g (0.25 mol) of potassium hydroxide and 200 g of DMF were refluxed for 10 hours. After the solvent was distilled off, the residue was extracted with chloroform, washed with water and subjected to chromatography (silica, chloroform-methanol) to separate 16.5 g of a light yellow liquid (compound [c] of the following structure, yield 69%).

[c]

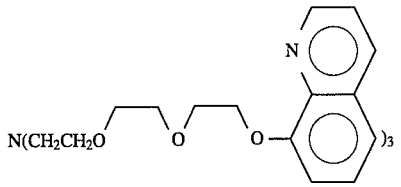

To 1.6 g (2 mmol) of compound [c] above, 0.3 g (2 mmol) of sodium iodide was added, and the mixture was made thermally molten and then cooled to yield a solid, which was then recrystallized from acetone-chloroform to yield 1.6 g (yield 84%) of the desired product as a white powder.

Synthesis Example 3 (Example Compound 8, KSCN Complex Salt)

Bis(2-chloroethyl)amine and propyl bromide were reacted to yield the following compound [d].

[d] $C_3H_7N(CH_2CH_2Cl)_2$

Next, 27.3 g (0.1 mol) of compound [d] above, 29.0 g (0.20 mol) of 8-hydroxyquinoline, 6.2 g (0.11 mol) of potassium hydroxide and 200 g of n-butanol were refluxed for 7 hours.

After the solvent was distilled off, the residue was extracted with chloroform, washed with water and subjected to chromatography (silica, chloroform-methanol) to separate 13.5 g of a light yellow liquid (compound [e] of the following structure, yield 32%).

[e]

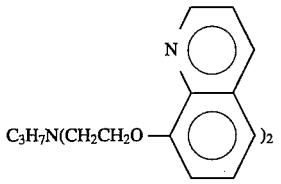

To 2.0 g (5 mmol) of compound [e] above, 0.5 g (5 mmol) of potassium thiocyanate was added, and the mixture was made thermally molten and then cooled to yield a solid, which was then recrystallized from acetone-chloroform to yield 1.3 g (yield 52%) of the desired product as a white power.

Synthesis Example 4 (Example Compound 13, $NH_4SCN$ Complex Salt)

13.3 g (0.05 mol) of 2,6-bis(bromomethyl)pyridine, 14.5 g (0.10 mol) of 8-hydroxyquinoline, 6.2 g (0.11 mol) of potassium hydroxide and 200 g of n-butanol were refluxed for 7 hours.

After the solvent was distilled off, the residue was extracted with chloroform, washed with water and subjected to chromatography (silica, chloroform-methanol) to separate 31 g of a light yellow liquid (compound [f] of the following structure, yield 47%).

[f]

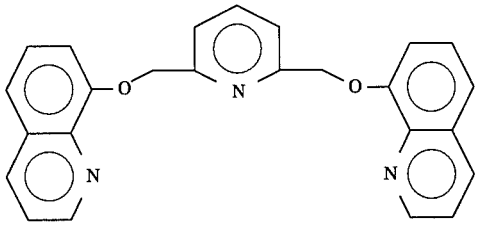

To 1.3 g (10 mmol) of compound [f] above, 0.76 g (10 mmol) of ammonium thiocyanate was added, and the mixture was made thermally molten and then cooled to yield a solid, which was then recrystallized from acetone-chloroform to yield 1.6 g (yield 78%) of the desired product as a white power.

The complex salt compounds represented by formulas [1], [2] and [3] are specified in Tables 1, 2 and 3 as Exm. com. (Example compound), respectively, which are not to be construed as limitative. In Tables 1, 2 and 3, Qr represents a residue of quinoline.

TABLE 1

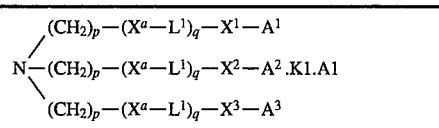

[1]

| Exm. Com. | $-(CH_2)_p-$ | $-(X^a-L^1)_q-$ | $-X^1-A^1$ $-X^2-A^2$ $-X^3-A^3$ | K1.A1 |
|---|---|---|---|---|
| 1 | $-(CH_2)_2-$ | q = O | $-O-Qr$ $-O-Qr$ $-O-Qr$ | RbI or $Ba(SCN)_2$ |
| 2 | $-(CH_2)_2-$ | 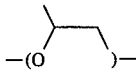 | $-O-Qr$ $-O-Qr$ $-O-Qr$ | RbI or $NH_4SCN$ |
| 3 | $-(CH_2)_2-$ | 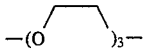 | $-O-Qr$ $-O-Qr$ $-O-Qr$ | NaI or KSCN |
| 4 | $-(CH_2)_2-$ | 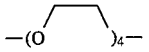 | $-O$-phenyl $-O$-phenyl $-O$-phenyl | $Ba(SCN)_2$ or $NH_4SCN$ |
| 5 | $-(CH_2)_2-$ | 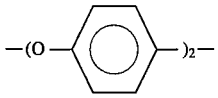 | $-O-Qr$ $-O-Qr$ $-O-Qr$ | NaI or KSCN |
| 6 | $-(CH_2)_2-$ | 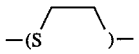 | $-O-Qr$ $-O-Qr$ $-O-Qr$ | $Ba(SCH)_2$ or $NH_4I$ |
| 7 | $-(CH_2)_2-$ | 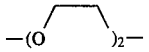 | $-S$-phenyl $-S$-phenyl $-S$-phenyl | NaF or KSCN |

40

TABLE 2

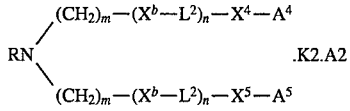

[2]

| Exm. com. | $-(CH_2)_m-$ | $-(X^b-L^2)_n-$ | $-X^4-A^4$ $-X^5-A^5$ | R | K2.A2 |
|---|---|---|---|---|---|
| 8 | $-(CH_2)_2-$ | n = O | $-O-Qr$ | $-C_3H_7$ | KSCN |
| 9 | $-(CH_2)_2-$ | 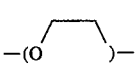 | $-O-Qr$ $-O-Qr$ | $-C_3H_7$ | RbI |
| 10 | $-(CH_2)_2-$ | 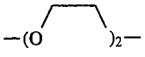 | $-O-Qr$ $-O-Qr$ | $-C_3H_7$ | $NH_4I$ |
| 11 | $-(CH_2)_2-$ | 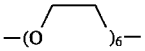 | $-O$-phenyl $-O$-phenyl | $-C_3H_7$ | $Ba(SCN)_2$ |
| 12 | $-(CH_2)_2-$ | 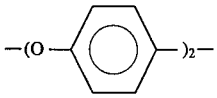 | $-O-Qr$ $-O-Qr$ | $-C_3H_7$ | KSCN |

TABLE 3

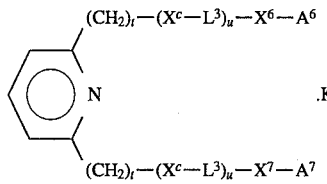

[3]

.K3.A3

| Exm. com. | $-(CH_2)_t-$ | $-(X^c-L^3)_u-$ | $-X^6-A^6$ $-X^7-A^7$ | K3.A3 |
|---|---|---|---|---|
| 13 | $-(CH_2)-$ | u = O | —O—Qr —O—Qr | $NH_4SCN$ |
| 14 | $-(CH_2)_2-$ | 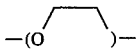 | —O—Qr —O—Qr | $Ba(SCN)_2$ |
| 15 | $-(CH_2)_2-$ | 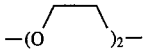 | —O—Qr —O—Qr | $Mg(SCN)_2$ |
| 16 | $-(CH_2)_2-$ | 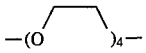 | —O-benzyl —O-benzyl | KSCN |
| 17 | $-(CH_2)_2-$ | 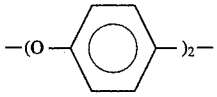 | —O—Qr —O—Qr | $(CH_3)_4NCl$ |

The positively chargeable toner for developing electrostatic images of the present invention preferably contains a (metal) complex salt compound as described above as a charge control agent in a ratio of 0.5 to 10 parts by weight, more preferably 1 to 5 parts by weight per 100 parts by weight of resin.

To improve toner quality, additives such as electroconductive grains, fluidity improving agents and image peeling preventing agents may be added internally or externally.

In addition, the (metal) complex salt compound used as a charge control agent may be used in combination with known positive charge control agents such as colored basic dyes (e.g., nigrosine dyes, triphenylmethane dyes) and colorless charge control agents (e.g., quaternary ammonium salts, polyamine resins), as long as their use does not interfere with the accomplishment of the object of the invention.

Examples of resins used in the toner of the present invention include the following known resins or binder resins for use in toners. Specifically, styrene resin, styrene-acrylic resin, styrene-butadiene resin, styrene-maleic acid resin, styrene-vinyl methyl ether resin, styrene-methacrylate copolymer, phenol resin, epoxy resin, polyester resin, polypropylene resin and paraffin wax may be used singly or in combination.

For preferable use of a resin or binder resin for toners in a toner used for full-color imaging by subtractive mixing or for OHP (overhead projectors) etc., the resin or binder resin is required to have special properties, for example, it should be transparent, substantially colorless (no tone damage occurs in the toner image), compatible with the charge control agent in the toner of the present invention, fluid under appropriate heat or pressure, and pulverizable. Examples of such resins for preferable use include styrene resin, acrylic resin, styrene-acrylic resin, styrene-methacrylate copolymer and polyester resin.

The toner of the present invention may incorporate various known dyes and pigments as coloring agents. Examples of such dyes or pigments which can be used in color toners include organic pigments such as carbon black, quinophthalone, Hansa Yellow, Rhodamine 6G Lake, quinacridone, Rose Bengale, copper Phthalocyanine Blue, copper Phthalocyanine Green and diketopyrrolopyrrole, various oil-soluble dyes or dispersion dyes such as azo dyes, quinophthalone dyes, anthraquinone dyes and phthalocyanine dyes, and triarylmethane dyes and xanthene dye modified with resins such as rosin, (rosin-modified) phenol and rosin-modified maleic acid.

The toner for developing electrostatic images of the present invention may incorporate the above-mentioned coloring agents singly or in combination.

Dyes and pigments having a good spectral property can be preferably used to prepare toners of the three primaries for full-color imaging. Chromatic monocolor toners may incorporate an appropriate combination of a pigment and dye of the same color tone, such as a quinophthalone pigment and dye, a rhodamine pigment and dye, or a phthalocyanine pigment and dye, as coloring agents.

The toner for developing electrostatic images of the present invention is, for example, produced as follows:

A toner having an average particle size of 5 to 20 μm can be obtained by thoroughly mixing a resin and coloring agent as described above, a (metal) complex salt compound as a charge control agent, and, if necessary, a magnetic material, a fluidizing agent and other additives, using a ball mill or another mechanical mixer, subsequently kneading the mixture in a molten state using a hot kneader such as a heat roll, kneader or extruder, cooling and solidifying the mixture, and then pulverizing the mixture and classifying the particles.

Other usable methods include the method in which the starting materials are dispersed in a binder resin solution and then spray dried, and the polymerizing toner production method in which a given set of starting materials are mixed in a monomer for binder resin to yield an emulsified suspension which is then polymerized to yield the desired toner.

When using the toner of the present invention as a two-component developer, development can be achieved by the two-component magnetic brush developing process or another process using the toner in mixture with a carrier powder.

Any known carrier can be used. Examples of the carrier include iron powder, nickel powder, ferrite powder and glass beads of about 50 to 200 μm in particle size, and such materials as coated with acrylate copolymer, styrene-acrylate copolymer, styrene-methacrylate copolymer, silicone resin, polyamide resin, ethylene fluoride resin or the like.

When using the toner of the present invention as a one-component developer, a fine powder of a ferromagnetic material such as iron powder, nickel powder or ferrite powder may be added and dispersed in preparing the toner as described above. Examples of developing processes which can be used in this case include contact development and jumping development.

EXAMPLES

The present invention is hereinafter described in more detail by means of the following examples, but these are not to be construed as limitative on the present invention. In the description below, "part(s) by weight" are referred to as "part(s)" for short.

Example 1

Styrene-Acrylic Copolymer Resin [HIMER SMB600 (Trade Name), Produced by Sanyo Kasei Co., Ltd.] . . . 100 Parts Xanthene Dye [Oil Pink #312 (Trade Name), Produced by Orient Chemical Industries Ltd.] . . . 6 Parts Example Compound 1 [RbI Complex Salt] . . . 2 Parts The above ingredients were uniformly pre-mixed using a high-speed mixer, and then kneaded in a molten state using an extruder, cooled, and roughly milled in a vibration mill. The obtained coarse product was finely pulverized using an air jet mill equipped with a classifier to obtain a transparent magenta toner of 10 to 20 μm in particle size.

5 parts of this toner was admixed with 95 parts of an iron powder carrier [TEFV 200/300 (trade name), produced by Nippon Teppun Co., Ltd.) to yield a developer. This developer was found to be +15.5 μC/g in the amount of initial blowoff charges. When this developer was used for repeated actual imaging, fog-free distinct images of good charge stability and retention without image density loss were obtained.

Example 2

Styrene-Acrylic Copolymer Resin [HIMER SMB600 (Trade Name), Produced by Sanyo Kasei Co., Ltd.] . . . 100 Parts C.I. Solvent Yellow 29 [Oil Yellow #129 (Trade Name), Produced by Orient Chemical Industries Ltd.] . . . 3 Parts Example Compound 3 [NaI Complex Salt] . . . 2 Parts The above ingredients were treated in the same manner as in Example 1 to yield a transparent yellow toner, which was then used to prepare a developer.

This developer was found to be +16.1 μC/g in the amount of initial blowoff charges. When this developer was used in repeated actual imaging, images of good quality as in Example 1 were obtained.

Example 3

Styrene-Acrylic Copolymer Resin [HIMER SMB600 (Trade Name), Produced by Sanyo Kasei Co., Ltd.] . . . 100 Parts Triarylmethane Blue Dye [Oil Blue #613 (Trade Name), Produced by Orient Chemical Industries Ltd.] . . . 5 Parts Example Compound 8 [KSCN Complex Salt] . . . 3 Parts The above ingredients were treated in the same manner as in Example 1 to yield a transparent blue toner, which was then used to prepare a developer.

This developer was found to be +15.8 μC/g in the amount of initial blowoff charges. When this developer was used in repeated actual imaging, images of good quality as in Example 1 were obtained.

Example 4

Styrene-Acrylic Copolymer Resin [HIMER SMB600 (Trade Name), Produced by Sanyo Kasei Co., Ltd.] . . . 100 Parts Carbon Black [MA-100 (Trade Name), Produced by Mitsubishi Chemical Industries, Ltd.] . . . 5 Parts Example Compound 13 [$NH_4SCN$ Complex Salt] . . . 2 Parts The above ingredients were treated in the same manner as in Example 1 to yield a black toner, which was then used to prepare a developer.

This developer was found to be +15.6 μC/g in the amount of initial blowoff charges. When this developer was used in repeated actual imaging, images of good quality as in Example 1 were obtained.

Example 5

Polyester Resin [HP-301 (Trade Name), Produced by the Nippon Synthetic Chemical Industry Co., Ltd.] . . . 100 Parts Tri-iron Tetroxide [EPT-500 (Trade Name), Produced by Toda Kogyo Corporation] . . . 40 Parts Low Polymer Polypropylene [Biscal 500-P (Trade Name), Produced by Sanyo Kasei Co., Ltd.] . . . 10 Parts Carbon Black [MA-100 (Trade Name), Produced by Mitsubishi Chemical Industries, Ltd.] . . . 6 Parts Example Compound 4 [$Ba(SCN)_2$ Complex Salt] . . . 2 Parts The above ingredients were uniformly pre-mixed using a ball mill to yield a premix, which was then kneaded in a molten state at 180° C. using a twin-screw extruder [PCM-30 (trade name), produced by Ikegai Seisakusho Co., Ltd.], cooled and thereafter roughly crushed, finely pulverized and classified to yield a one-component toner of 5 to 15 μm in particle size.

When this toner was used for a commercial copying machine to form toner images, fog-free high-quality images of good thin-line reproducibility were obtained, which had a solid portion reflecting density of 1.3.

Comparative Example 1

For comparison of chargeability, a magenta toner was prepared in the same manner as in Example 1, except that Example Compound 1 [RbI complex salt] used in Example 1 was replaced with tetramethylammonium chloride.

This developer was found to be +5.3 μC/g in the amount of initial blowoff charges. The chargeability of this developer lacked stability and durability.

Comparative Example 2

A black toner was prepared in the same manner as in Example 4, except that Example Compound 13 [$NH_4SCN$ complex salt] was not used. When this toner was evaluated as to performance in actual imaging in the same manner as in Example 4, image scattering, disturbance, fogging, etc. were noted, indicating that the requirements for toners were not satisfied.

What is claimed is:

1. Positively chargeable toner for developing electrostatic images which comprises a toner resin, a coloring agent and a charge control agent whose active ingredient is a complex salt compound selected from the group consisting of a compound of formula [1], a compound of formula [2] and a compound of formula [3]:

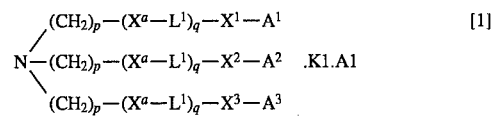

[1]

.K1.A1 wherein with respect to formula [1]:

$X^a$, $X^1$, $X^2$ and $X^3$ independently represent —O— or —S—, $L^1$ represents a divalent group selected from the group consisting of an alkylene group having 1 to 4 carbon atoms which is branched or not branched, a cycloalkylene group and a monocyclic or polycyclic arylene group which is optionally substituted with a substituent selected from the group consisting of tert-butyl, chloro and nitro, $A^1$, $A^2$ and $A^3$ independently represent hydrogen, an alkyl group, a cycloalkyl group, an aralkyl group, a monocyclic aryl group which is optionally substituted with a substituent selected from the group consisting of methyl, tert-butyl, octyl, chloro, nitro, hydroxyl and thiol, a polycyclic aryl group which is optionally substituted with a substituent selected from the group consisting of alkyl, halogen, nitro and hydroxyl, or a residue of a nitrogen-containing heterocyclic compound having an —OH or —SH group, p represents an integer from 1 to 4, q represents an integer from 0 to 20, and 1·A1 represents an organic or inorganic salt capable of forming a complex with an amine compound, in which K1 is a cation selected from the group consisting of alkali metal ions, alkaline earth metal ions, ammonium ions and pyridinium ions, and A1 is an anion of an organic or inorganic acid;

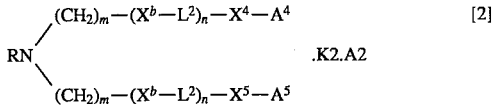

[2]

.K2.A2 wherein with respect to formula [2]:

R represents an alkyl group having 1 to 20 carbon atoms or an aralkyl group having 7 to 12 carbon atoms, each of which is optionally substituted with a substituent selected from the group consisting of alkyl, halogen, cyano and hydroxyl, $X^b$, $X^4$ and $X^5$ independently represent —O— or —S—, $L^2$ represents a divalent group selected from the group consisting of an alkylene group having 1 to 4 carbon atoms which is branched or not branched, a cycloalkylene group and a monocyclic or polycyclic arylene group which is optionally substituted with a substituent selected from the group consisting of tert-butyl, chloro and nitro, $A^4$ and $A^5$ independently represent hydrogen, an alkyl group, a cycloalkyl group, an aralkyl group, a monocyclic aryl group which is optionally substituted with a substituent selected from the group consisting of methyl, tert-butyl, octyl, chloro, nitro, hydroxyl and thiol, a polycyclic aryl group which is optionally substituted with a substituent selected from the group consisting of alkyl, halogen, nitro and hydroxyl, or a residue of a nitrogen-containing heterocyclic compound having an —OH or —SH group, m represents an integer from 1 to 4, n represents an integer from 0 to 20, and K2·A2 represents an organic or inorganic salt capable of forming a complex with an amine compound, in which K2 is a cation selected from the group consisting of alkali metal ions, alkaline earth metal ions, ammonium ions and pyridinium ions, and A2 is an anion of an organic or inorganic acid; and

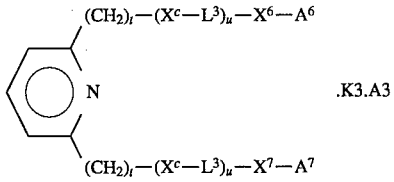

[3]

.K3.A3 wherein with respect to formula [3]:

$X^c$, $X^6$ and $X^7$ independently represent —O— or —S—, $L^3$ represents a divalent group selected from the group consisting of an alkylene group having 1 to 4 carbon atoms which is branched or not branched, a cycloalkylene group and a monocyclic or polycyclic arylene group which is optionally substituted with a substituent selected from the group consisting of tert-butyl, chloro and nitro, $A^6$ and $A^7$ independently represent hydrogen, an alkyl group, a cycloalkyl group, an aralkyl group, a monocyclic aryl group which is optionally substituted with a substituent selected from the group consisting of methyl, tert-butyl, octyl, chloro, nitro, hydroxyl and thiol, a polycyclic aryl group which is optionally substituted with a substituent selected from the group consisting of alkyl, halogen, nitro and hydroxyl, or a residue of a nitrogen-containing heterocyclic compound having an —OH or —SH group, t represents an integer from 1 to 4, u represents an integer from 0 to 20, and K3·A3 represents an organic or inorganic salt capable of forming a complex with a pyridine compound, in which K3 is a cation selected from the group consisting of alkali metal ions, alkaline earth metal ions, ammonium ions and pyridinium ions, and A3 is an anion of an organic or inorganic acid.

2. Toner of claim 1 wherein K1·A1, K2·A2 and K3·A3 are alkali metal salts, alkaline earth metal salts or ammonium salts of thiocyanic acid.

3. Toner of claim 1 wherein $A^1$, $A^2$, $A^3$, $A^4$, $A^5$, $A^6$ and $A^7$ are residues of nitrogen-containing heterocyclic compounds having an —OH group.

4. Positively chargeable toner for developing electrostatic images which comprises a toner resin, a coloring agent and a charge control agent whose active ingredient is a complex salt compound of formula [1]:

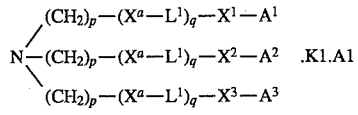

[1]

.K1.A1 wherein:

$X^a$, $X^1$, $X^2$ and $X^3$ independently represent —O— or —S—, $L^1$ represents a divalent group selected from the group consisting of an alkylene group having 1 to 4 carbon atoms which is branched or not branched, a cycloalkylene group and a monocyclic or polycyclic arylene group which is optionally substituted with a substituent selected from the group consisting of tert-butyl, chloro and nitro, $A^1$, $A^2$ and $A^3$ independently represent hydrogen, an alkyl group, a cycloalkyl group, an aralkyl group, a monocyclic aryl group which is optionally substituted with a substituent selected from the group consisting of methyl, tert-butyl, octyl, chloro, nitro, hydroxyl and thiol, a polycyclic aryl group which is optionally substituted with a substituent selected from the group consisting of alkyl, halogen, nitro and hydroxyl, or a residue of a nitrogen-containing heterocyclic compound having an —OH or —SH group, p represents an integer from 1 to 4, q represents an integer from 0 to 20, and K1·A1 represents an organic or inorganic salt capable of forming a complex with an amine compound, in which K1 is a cation selected from the group consisting of alkali metal ions, alkaline earth metal ions, ammonium ions and pyridinium ions, and A1 is an anion of an organic or inorganic acid.

5. Toner of claim 4 wherein K1·A1 is an alkali metal salt, alkaline earth metal salt or ammonium salt of thiocyanic acid.

6. Toner of claim 4 wherein $A^1$, $A^2$ and $A^3$ are residues of nitrogen-containing heterocyclic compounds having an —OH group.

7. Positively chargeable toner for developing electrostatic images which comprises a toner resin, a coloring agent and a charge control agent whose active ingredient is a complex salt compound of formula [2]:

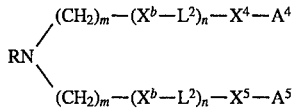

[2]

.K2.A2 wherein:

R represents an alkyl group having 1 to 20 carbon atoms or an aralkyl group having 7 to 12 carbon atoms, each of which is optionally substituted with a substituent selected from the group consisting of alkyl, halogen, cyano and hydroxyl, $X^b$, $X^4$ and $X^5$ independently represent —O— or —S—, $L^2$ represents a divalent group selected from the group consisting of an alkylene group having 1 to 4 carbon atoms which is branched or not branched, a cycloalkylene group and a monocyclic or polycyclic arylene group which is optionally substituted with a substituent selected from the group consisting of tert-butyl, chloro and nitro, $A^4$ and $A^5$ independently represent hydrogen, an alkyl group, a cycloalkyl group, an aralkyl group, a monocyclic aryl group which is optionally substituted with a substituent selected from the group consisting of methyl, tert-butyl, octyl, chloro, nitro, hydroxyl and thiol, a polycyclic aryl group which is optionally substituted with a substituent selected from the group consisting of alkyl, halogen, nitro and hydroxyl, or a residue of a nitrogen-containing heterocyclic compound having an —OH or —SH group, m represents an integer from 1 to 4, n represents an integer from 0 to 20, and K2·A2 represents an organic or inorganic salt capable of forming a complex with an amine compound, in which K2 is a cation selected from the group consisting of alkali metal ions, alkaline earth metal ions, ammonium ions and pyridinium ions, and A2 is an anion of an organic or inorganic acid.

8. Toner of claim 7 wherein K2·A2 is an alkali metal salt, alkaline earth metal salt or ammonium salt of thiocyanic acid.

9. Toner of claim 7 wherein $A^4$ and $A^5$ are residues of nitrogen-containing heterocyclic compounds having an —OH group.

10. Positively chargeable toner for developing electrostatic images which comprises a toner resin, a coloring agent and a charge control agent whose active ingredient is a complex salt compound of formula [3]:

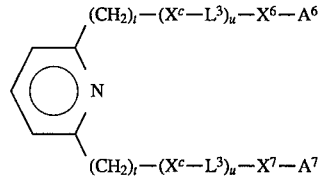

[3]

.K3.A3 wherein:

$X^c$, $X^6$ and $X^7$ independently represent —O— or —S—, $L^3$ represents a divalent group selected from the group consisting of an alkylene group having 1 to 4 carbon atoms which is branched or not branched, a cycloalkylene group and a monocyclic or polycyclic arylene group which is optionally substituted with a substituent selected from the group consisting of tert-butyl, chloro and nitro, $A^6$ and $A^7$ independently represent hydrogen, an alkyl group, a cycloalkyl group, an aralkyl group, a monocyclic aryl group which is optionally substituted with a substituent selected from the group consisting of methyl, tert-butyl, octyl, chloro, nitro, hydroxyl and thiol, a polycyclic aryl group which is optionally substituted with a substituent selected from the group consisting of alkyl, halogen, nitro and hydroxyl, or a residue of a nitrogen-containing heterocyclic compound having an —OH or —SH group, t represents an integer from 1 to 4, u represents an integer from 0 to 20, and K3·A3 represents an organic or inorganic salt capable of forming a complex with a pyridine compound, in which K3 is a cation selected from the group consisting of alkali metal ions, alkaline earth metal ions, ammonium ions and pyridinium ions, and A3 is an anion of an organic or inorganic acid.

11. Toner of claim 10 wherein K3·A3 is an alkali metal salt, alkaline earth metal salt or ammonium salt of thiocyanic acid.

12. Toner of claim 10 wherein $A^6$ and $A^7$ are residues of nitrogen-containing heterocyclic compounds having an —OH group.

* * * * *